US009494102B2

(12) United States Patent
Strasser

(10) Patent No.: US 9,494,102 B2
(45) Date of Patent: Nov. 15, 2016

(54) METHOD FOR OPERATING A FUEL INJECTION SYSTEM OF AN INTERNAL COMBUSTION ENGINE

(75) Inventor: Markus Strasser, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 1042 days.

(21) Appl. No.: 13/451,094

(22) Filed: Apr. 19, 2012

(65) Prior Publication Data

US 2012/0283933 A1 Nov. 8, 2012

(30) Foreign Application Priority Data

May 3, 2011 (DE) ..... 10 2011 075 124

(51) Int. Cl.
*F02D 41/38* (2006.01)
*F02D 41/24* (2006.01)
*F02D 41/22* (2006.01)

(52) U.S. Cl.
CPC ..... *F02D 41/3809* (2013.01); *F02D 41/247* (2013.01); *F02D 41/2438* (2013.01); *F02D 2041/223* (2013.01)

(58) Field of Classification Search
CPC ..... F02D 2041/223; F02D 41/2438; F02D 41/247; F02D 41/3809; F02D 41/3872
USPC ..... 701/103, 104, 114; 123/350, 447, 456, 123/497, 478, 479, 494, 511, 514; 73/114.45, 114.48, 119 A
See application file for complete search history.

(56) References Cited

U.S. PATENT DOCUMENTS

| | | | | |
|---|---|---|---|---|
| 6,076,504 | A * | 6/2000 | Stavnheim et al. | 123/447 |
| 6,283,108 | B1 * | 9/2001 | Matsufuji et al. | 123/690 |
| 6,378,498 | B2 * | 4/2002 | Kohketsu et al. | 123/447 |
| 7,210,459 | B2 * | 5/2007 | Shibata | 123/456 |
| 8,091,532 | B2 * | 1/2012 | Wang et al. | 123/446 |
| 2010/0275679 | A1 * | 11/2010 | Wang et al. | 73/114.42 |

OTHER PUBLICATIONS

K. Mollenhauer, H. Tschoeke, Handbook of Diesel Engines, Springer-Verlag Berling Heidelberg, 2010, pp. 31-38, "Gas Exchange and Supercharing", Helmut Pucher.
"Development of a Two-stage Variable Compression Ratio Engine", http://www.fev.com/fileadmin/user_upload/Media/TechnicalPublications/Gasoline_Systems/TwoStageVariableCompressionRatiowithEccentricPistonPin.pdf, Dec. 12, 2007, 11 pages.

(Continued)

*Primary Examiner* — Carl Staubach
(74) *Attorney, Agent, or Firm* — Norton Rose Fulbright US LLP; Gerard Messina

(57) ABSTRACT

A method for operating a fuel injection system of an internal combustion engine is described in which pressurized fuel is provided in a pressure storage device and a fuel pressure prevailing in pressure storage device is regulated with the aid of a pressure regulation, during a first measuring interval at least one fuel withdrawal from the pressure storage device taking place, and during a second measuring interval no fuel withdrawal from the pressure storage device of this type taking place, and during the first and the second measuring intervals a performance quantity of the pressure regulation being ascertained in each case, and the fuel quantity withdrawn during the first measuring interval being ascertained for the at least one withdrawal from a difference of the ascertained performance quantities of the pressure regulation.

23 Claims, 5 Drawing Sheets

(56) References Cited

OTHER PUBLICATIONS

"Direct Gasoline Injection in the Negative Valve Overlap of a Homogenous Charge Compression Ignition Engine", http://papers.sae.org/2003-01-1854/, May 19, 2003, 2 pages (Abstract only).

* cited by examiner

METHOD FOR OPERATING A FUEL INJECTION SYSTEM OF AN INTERNAL COMBUSTION ENGINE

RELATED APPLICATION INFORMATION

The present application claims priority to and the benefit of German patent application no. 10 2011 075 124.6, which was filed in Germany on May 3, 2011, the disclosure of which is incorporated herein by reference.

FIELD OF THE INVENTION

The present invention relates to a method, as well as a computer program and a control and/or regulating unit.

BACKGROUND INFORMATION

Injectors of internal combustion engines are known from the market, which are activated via a so-called "servo-valve" which is activated electrically. When the servo-valve is activated, fuel pressure is reduced in a control chamber of the injector, the fuel being discharged via hydraulic throttles into an injector return line. With the aid of the thus produced pressure difference, an injection nozzle may be opened and fuel may be injected into a combustion chamber of the internal combustion engine.

Fuel must be supplied continuously into the pressure storage device, so that hydraulic pressure is not reduced in the pressure storage device (fuel storage device, "rail") which supplies the injector. The fuel is continuously supplied with the aid of a pressure regulation, an instantaneous fuel pressure being ascertained with the aid of a pressure sensor ("rail pressure sensor"). As a result, an appropriate quantity of fuel may be supplied into the pressure storage device with the aid of a fuel metering device.

SUMMARY OF THE INVENTION

An object underlying the exemplary embodiments and/or exemplary methods of the present invention is achieved by a method according to the description herein as well as by a computer program and a control and/or regulating unit according to the further descriptions herein. Advantageous refinements are also specified herein.

The exemplary embodiments and/or exemplary methods of the present invention relate to a method for operating a fuel injection system of an internal combustion engine in which pressurized fuel is provided in a pressure storage device and a fuel pressure prevailing in the pressure storage device is regulated with the aid of a pressure regulation. According to the exemplary embodiments and/or exemplary methods of the present invention, at least one withdrawal of fuel from the pressure storage device takes place during a first measuring interval, and no fuel withdrawal from the pressure storage device of this type takes place during a second measuring interval. During the first and the second measuring intervals, one performance quantity of the pressure regulation is ascertained in each case. With the aid of the performance quantity, a rate of the fuel withdrawn from the pressure storage device in each case may be ascertained. "Rate" of the fuel is understood to mean the quotient from the fuel quantity (control quantity), which has been withdrawn from or supplied to the pressure storage device, and an associated time interval.

The fuel quantity withdrawn during the first measuring interval may particularly be ascertained for the at least one withdrawal from a difference of the ascertained performance quantities of the pressure regulation. The difference characterizes the withdrawn fuel rate in each case. As a result of the described difference, the control quantity withdrawn during the first measuring interval may be ascertained relatively accurately.

It is advantageous if the first and the second measuring intervals are positioned adjacently with regard to time. The measuring intervals may follow one another very closely or even directly and have the same duration. For this purpose, the two measuring intervals do not have to take place in a specific order, i.e., the second measuring interval may succeed or precede the first measuring interval. Furthermore, the first or the second measuring interval may include an operating cycle of the internal combustion engine or a part of the operating cycle or multiple operating cycles. Here, it is not necessary for the fuel to be injected into the combustion chamber of the internal combustion engine during the measuring intervals, as will be explained below.

The method according to the present invention has the advantage that a pressure sensor of a pressure regulation in a fuel injection system of an internal combustion engine may be monitored and quantitatively evaluated. In general, no additional components are necessary for this purpose. The method may be performed in a relatively accurate and permanently stable manner.

It is provided, in particular, that the at least one fuel withdrawal is carried out by activating a servo-valve of an injector of the internal combustion engine in such a way that a control quantity of the fuel is withdrawn, at which the injector does not yet inject fuel into a combustion chamber of the internal combustion engine. In this case, the injector is activated for such a short period of time that although the servo-valve is activated, a valve needle, which cooperates with an outlet orifice (injection nozzle) of the injector, for example, does not lift from its valve seat (blank shot). On the one hand, no fuel is thus injected yet into the combustion chamber of the internal combustion engine. On the other hand, the control quantity (blank-shot quantity) of the fuel required for the short activation of the servo-valve is supplied to an injector return line, thus reducing the pressure in the pressure storage device to a corresponding extent in each case. A defined additional fuel quantity is thus withdrawn from the pressure storage device, which is quickly compensated for with the aid of the pressure regulation, via the described activation of the injector, i.e., an activation of an actuator activating the injector.

In addition to the fuel quantities injected during the operation of the internal combustion engine, fuel withdrawal from the pressure storage device takes place as a result of injector leakages, which are supplied to the injector return line just as the control quantity which is withdrawn according to the exemplary embodiments and/or exemplary methods of the present invention. This is continuously offset by the pressure regulation in each case. The leakages depend to a relatively large extent on fuel pressure and fuel temperature. In addition, the leakages may change over the lifetime of the injector, i.e., they usually become greater over time. On the other hand, the particular control quantities essentially depend on the fuel pressure and the activation period. Furthermore, the control quantities may be less dependent on the fuel temperature and the fuel type, as the case may be.

It has been recognized according to the exemplary embodiments and/or exemplary methods of the present invention that the control quantities are, however, independent from or depend only to a small extent on the aging of the injector. During an identical activation period of the injector, in each case, the control quantities of the fuel also essentially depend solely on the fuel pressure. It is thus possible to prompt the pressure regulation to subsequently supply additional quantities of fuel with the aid of targeted withdrawals of the control quantities, a manipulated variable of the pressure regulation being ascertained as the performance quantity. The fuel pressure prevailing in the pressure storage device may be deduced therefrom. By evaluating the manipulated variable the pressure sensor may thus be quantitatively monitored, the leakages being identical in the first and the second measuring intervals, and thus do not influence the difference between the ascertained performance quantities.

One embodiment of the present invention provides that a or the servo-valve of an or the injector of the internal combustion engine is activated multiple times for withdrawing a control quantity during the first measuring interval, the activation may take place periodically. Due to the plurality of withdrawn control quantities, the total of the withdrawn fuel quantity becomes larger, whereby the accuracy of the method may be improved. In addition, the periodical activation simplifies the method.

The method may be carried out more easily and in an improved manner if the method is carried out in an operating mode of the internal combustion engine in which usually no injection of fuel into a combustion chamber of the internal combustion engine is provided, in particular, in a coasting mode and/or during a gas exchange phase. In this way, possible interferences may be minimized and the operating conditions of the internal combustion engine may be reproduced particularly well during the measuring intervals. By using the gas exchange phase it is, however, also possible to carry out the method when the internal combustion engine is under load.

The method according to the present invention may, for example, be carried out according to the following steps:

(a) the fuel pressure in the pressure storage device is regulated to an identical pressure setpoint value, in each case, with the aid of the pressure regulation during the first and the second measuring intervals;

(b) the injector is activated during the first measuring interval in such a way that a control quantity of the fuel is withdrawn from the pressure storage device, the injector not yet injecting fuel into the combustion chamber;

(c) during activation of the injector, a first value of the performance quantity of the pressure regulation, in particular a manipulated variable of a pressure regulator and/or a fuel metering device and/or a pressure regulation valve, is ascertained;

(d) the injector is activated during the second measuring interval in such a way that no control quantity of the fuel is withdrawn from the pressure storage device;

(e) a second value of the performance quantity of the pressure regulation is ascertained;

(f) a difference between the first value and the second value of the performance quantity is ascertained; and (g) the difference is compared to a difference, which has been ascertained under comparable conditions and which is stored in a control and/or regulating unit of the internal combustion engine, and a state of the pressure sensor is deduced therefrom.

The withdrawal of the control quantity during the first measuring interval takes place at a rate as constant as possible, e.g., with the aid of the periodical activation described above. According to the exemplary embodiments and/or exemplary methods of the present invention, the state of the pressure sensor is thus deduced from ascertaining a performance quantity—which is a function of the fuel withdrawal rate—, e.g., a manipulated variable or a variable of the pressure regulation characterizing the manipulated variable. For this purpose, a defined quantity or rate of the fuel is additionally withdrawn from the pressure storage device in a first case (first measuring interval), and no fuel is withdrawn in a second case (second measuring interval). Here, the injector is appropriately activated electrically during the first measuring interval, and is, for example, not activated during the second measuring interval.

The remaining operating conditions of the fuel injection system should be comparable during the first and the second measuring intervals. In both cases, the fuel pressure in the pressure storage device is regulated as constantly as possible to the pressure setpoint value with the aid of the pressure regulation. For this purpose, it is necessary for the pressure regulation to appropriately set the manipulated variable in each case. Since a greater fuel rate quantity is withdrawn from the pressure storage device during the first measuring interval than during the second measuring interval, the values of the performance quantities vary accordingly.

The control quantity for individual activation of the servo-valve is relatively independent from aging when used in customary specific embodiments of injectors. Accordingly, a defined periodical withdrawal of control quantities results in a fuel withdrawal rate which is likewise essentially independent from aging. The resulting difference essentially depends therefore on the fuel pressure and the withdrawal rate. The change in the performance quantity or the manipulated variable of the pressure regulation when comparing the first and the second measuring intervals is thus a relatively accurate measure for the fuel rate to be subsequently supplied to the pressure storage device.

It is furthermore provided that occasionally and/or periodically values of the performance quantity of the pressure regulation are ascertained during the first and the second measuring intervals, and that these values are compared to the values detected during the first and the second measuring intervals in the new condition of the fuel injection system and/or the injector and/or the pressure sensor, and that a state of the pressure sensor may be deduced from the comparison. In the case that the difference ascertained between the values of the performance quantity is greater than a stored difference, which was ascertained under comparable conditions, e.g., when the fuel system was new, it is assumed according to the exemplary embodiments and/or exemplary methods of the present invention that the pressure sensor displays an excessively low fuel pressure of the pressure storage device, i.e., the actual fuel pressure is higher. In the case that the difference ascertained is smaller than the stored difference, it is assumed that the pressure sensor displays an excessively high fuel pressure of the pressure storage device, i.e., the actual fuel pressure is lower. Thus, the state of the pressure sensor may be quantitatively evaluated and its function may be checked for plausibility.

It is furthermore provided that the performance quantity of the pressure regulation is ascertained at different fuel pressures and/or at different fuel temperatures and/or for different fuel types and/or for different activation periods of the injector or the servo-valve of the injector. Important parameters are thus described which may quantitatively influence the control quantity of the fuel when the injector is activated. According to the exemplary embodiments and/or exemplary methods of the present invention, these parameters are also detected and also stored. The storage may take place with the aid of a table and/or a characteristic diagram in a data storage of the control and/or regulating unit. It is thus possible to compare the particular control quantities with a new condition of the fuel injection system as a function of these parameters, thus improving the accuracy of the method.

A counter number (e.g., 1 through 4 in a four-cylinder engine) of the injector may additionally be ascertained as a parameter and also used for the method. Thus, possible individual differences between multiple injectors may be taken into account.

The injector may be manufactured by measuring samples of the injector on a hydraulic test bench. For this purpose, the servo-valve of the injector is activated in such a way that a control quantity of the fuel is withdrawn in which the injector does not yet distribute fuel and in which the withdrawn control quantity is ascertained and a variable characterizing the withdrawn control quantity and/or a fuel withdrawal rate and/or a difference of the performance quantities between the first and the second measuring intervals is/are stored in a characteristic diagram as a function of a fuel pressure and/or a fuel temperature and/or a fuel type and/or an activation period for the injector or the servo-valve of the injector. The control quantities thus ascertained from the samples may be stored as a function of the mentioned parameters for a series of injectors in the particular control and/or regulating unit of the internal combustion engine. As a result, when the internal combustion engine or the fuel injection system is new, it is no longer necessary to ascertain the control quantity, resulting in the ability to save costs.

It is furthermore provided that the method according to the present invention is carried out at least partially with the aid of a computer program which is stored on the control and/or regulating unit of the internal combustion engine. This allows the steps and arithmetic operations required for the method to be processed quickly and relatively easily.

Features which are important for the exemplary embodiments and/or exemplary methods of the present invention are furthermore specified in the following drawings; the features may be important for the exemplary embodiments and/or exemplary methods of the present invention both alone and in different combinations without explicit reference being made thereto again.

Exemplary specific embodiments of the present invention are explained below, with reference to the drawings.

DETAILED DESCRIPTION

Figure 1:
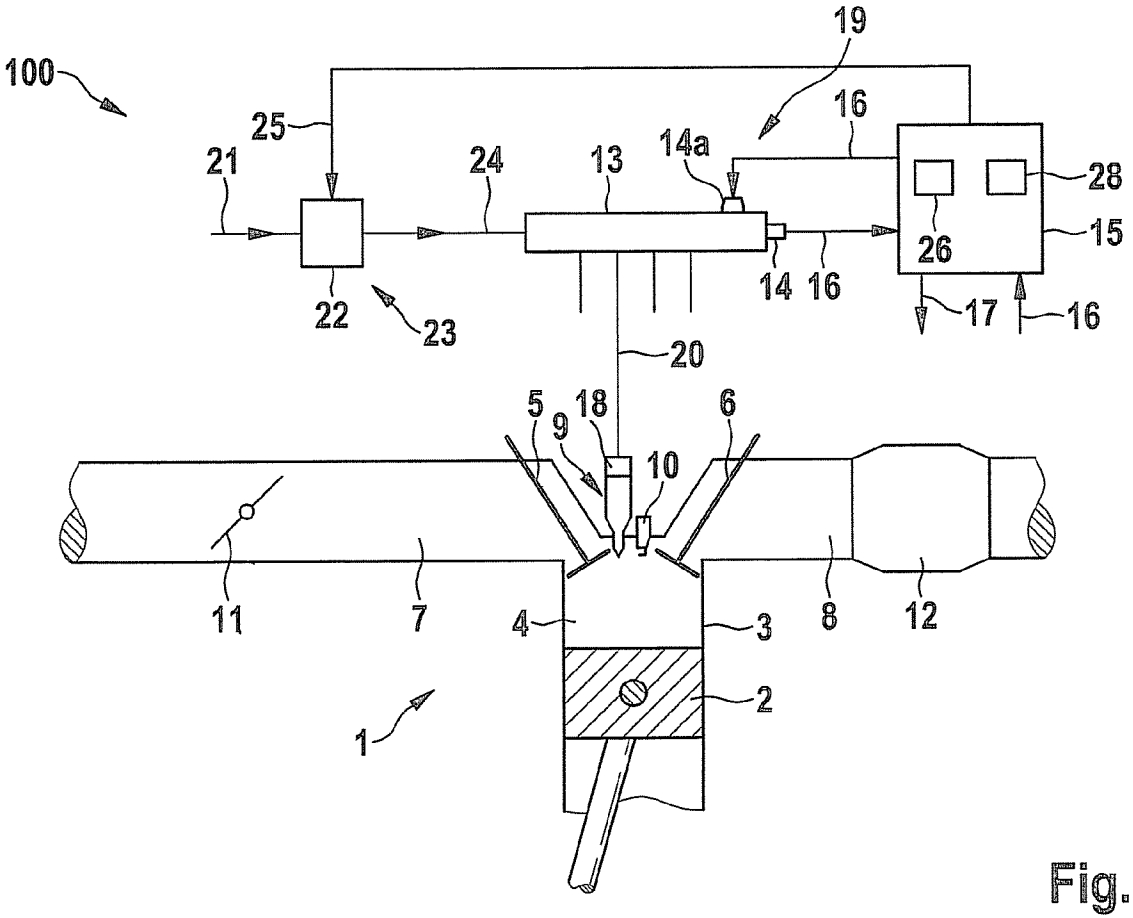
FIG. 1 shows a simplified diagram of a fuel injection system of an internal combustion engine.

The same reference numerals are used for functionally equivalent elements and variables in all figures, even in different specific embodiments.

FIG. 1 shows an internal combustion engine 1 of a motor vehicle, in which a piston 2 is movable back and forth in a cylinder 3. Cylinder 3 is provided with a combustion chamber 4 which is delimited by piston 2, an inlet valve 5 and an outlet valve 6, among other things. Inlet valve 5 is coupled to an intake manifold 7, and outlet valve 6 is coupled to an exhaust pipe 8.

In the area of inlet valve 5 and outlet valve 6, an injector 9 and a spark plug 10 protrude into combustion chamber 4. Injector 9 includes a servo-valve (not shown in the drawing of FIG. 1) which may be activated by an actuator 18. If the servo-valve is activated long enough, fuel may be injected into combustion chamber 4. Spark plug 10 may be used to ignite the fuel in combustion chamber 4. A fuel injection system of internal combustion engine 1 is indicated with reference numeral 100.

A rotatable throttle valve 11, via which air may be supplied to intake manifold 7, is accommodated in intake manifold 7. The quantity of air supplied depends on the angular position of throttle valve 11. A catalytic converter 12, which is used to clean the exhaust gases created as a result of the fuel combustion, is accommodated in exhaust pipe 8.

A low-pressure line 21 supplies fuel to a fuel metering device 22 and to a high-pressure pump 23 which is coupled to fuel metering device 22. High-pressure pump 23 (not visible in the drawing) is an electric and/or mechanical fuel pump which is suitable for supplying fuel with the necessary pressure in each case. High-pressure pump 23 pumps the fuel into a pressure storage device 13 with the aid of a feed line 24. Injector 9 is connected to pressure storage device 13 via a pressure line 20. Accordingly, injectors 9 of the remaining cylinders 3 (not shown) of internal combustion engine 1 are connected to pressure storage device 13; this is, however, indicated only by short vertical lines at pressure storage device 13 in the drawing of FIG. 1.

Furthermore, a pressure sensor 14, which may be used to measure the pressure in pressure storage device 13, is situated on pressure storage device 13. This pressure is the pressure that is applied to the fuel and using which the fuel may thus be injected via injector 9 into combustion chamber 4 of internal combustion engine 1. Fuel injection system 100 may also have a pressure regulation valve **14*a* which is designed to withdraw fuel from pressure storage device 13**.

Input signals 16, which represent the performance quantities of internal combustion engine 1 measured with the aid of sensors, are applied to a control and/or regulating unit 15 in the right-hand upper area of the drawing according to FIG. 1. For example, control and/or regulating unit 15 is connected to pressure sensor 14, an air mass sensor in intake manifold 7, a lambda sensor in exhaust pipe 8, a speed sensor and the like. Control and/or regulating unit 15 generates output signals 17 using which the behavior of internal combustion engine 1 may be influenced via actuators. For example, control and/or regulating unit 15 is connected to actuator 18 of injector 9, spark plug 10, throttle valve 11, pressure regulation valve **14*a* and the like, and generates the signals necessary to activate them. Control and/or regulating unit 15 includes a computer program 26 and a characteristics map 28**.

Control and/or regulating unit 15 is provided, among other things, for controlling and/or regulating performance quantities of internal combustion engine 1. For example, the fuel mass, which is injected into combustion chamber 4 by injector 9, is controlled and/or regulated by control and/or regulating unit 15 as a function of a desired torque of internal combustion engine 1, taking into account low fuel consumption and/or low exhaust emissions.

In particular, fuel metering device 22, pressure storage device 13, pressure sensor 14, pressure regulation valve **14*a*, and control and/or regulating unit 15 are elements of a pressure regulation 19 of fuel injection system 100. For this purpose, control and/or regulating unit 15 has a microprocessor (not shown) which has computer program 26** stored on a storage medium suitable for carrying out the control and/or regulation mentioned above.

While internal combustion engine 1 is in operation, fuel is supplied into pressure storage device 13. This fuel is injected into associated combustion chambers 4 via injectors 9 of individual cylinders 3. With the aid of spark plugs 10, combustions are generated in combustion chambers 4 which prompt pistons 2 to move back and forth. These movements are transferred to a crankshaft (not shown) and apply a torque on the crankshaft. An instantaneous fuel pressure is ascertained in pressure storage device 13 with the aid of pressure sensor 14. With the aid of a manipulated variable 25, fuel metering device 22 is controlled by control and/or regulating unit 15 in such a way that the necessary fuel pressure in pressure storage device 13 may be held as constant as possible in each particular case. Alternatively or additionally, pressure regulation valve 14*a* may be activated in a manner known per se in order to influence the fuel pressure in pressure storage device 13. For this purpose, pressure regulation valve 14*a* may be assigned its own manipulated variable (comparable to manipulated variable 25 of fuel metering device 22).

Figure 3:
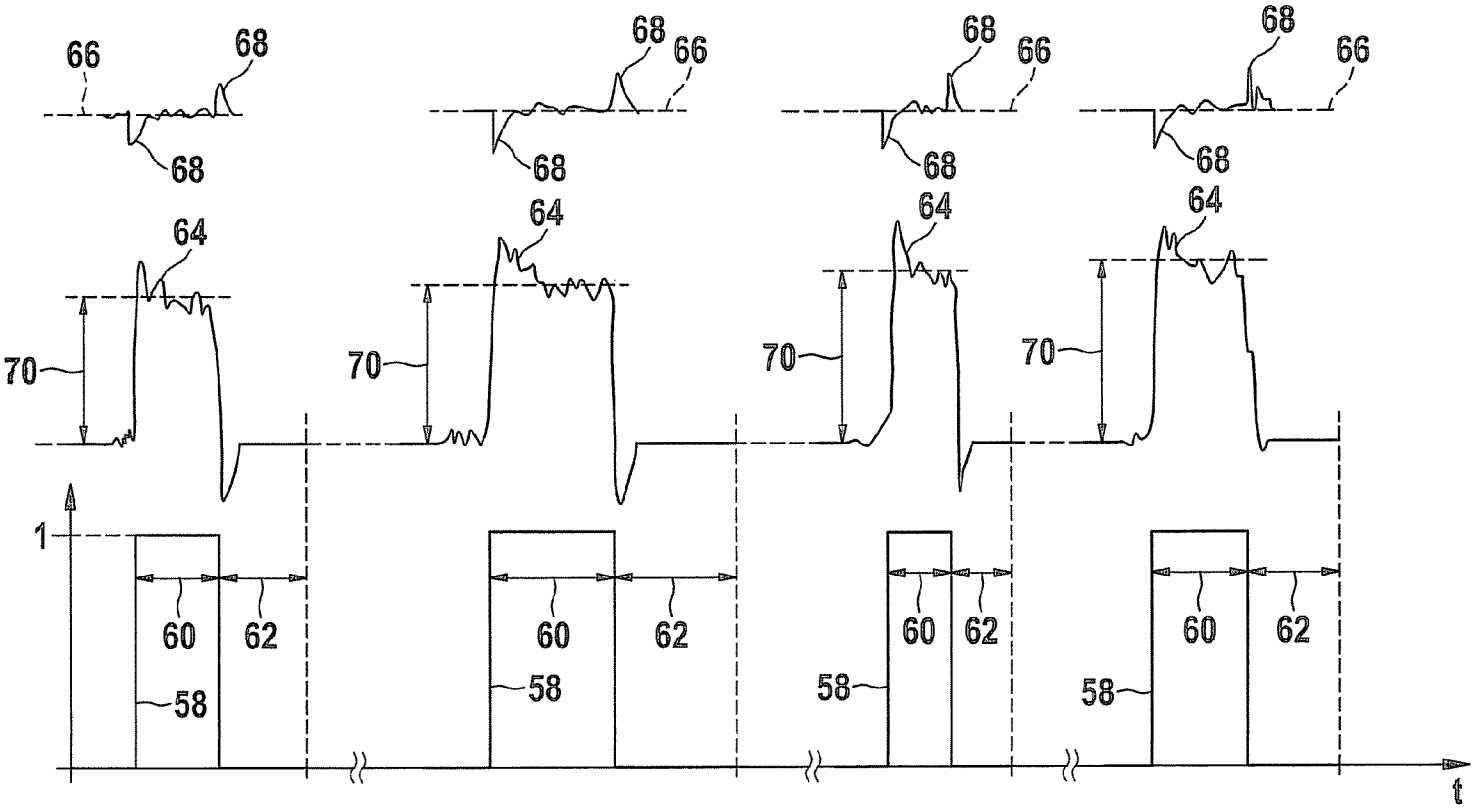
FIG. 3 shows a first diagram having the delivery quantities and pressures of a fuel.
Figure 5:
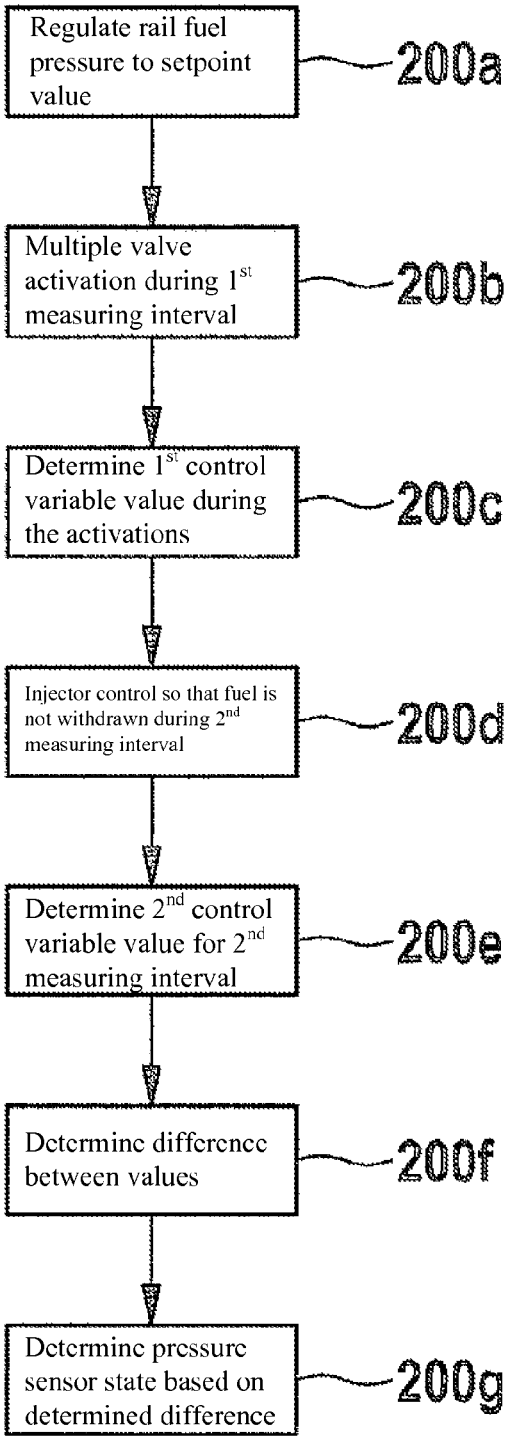
FIG. 5 shows a simplified flow chart of a specific embodiment of the method according to the present invention.

According to the illustration in FIG. 1, the method according to the present invention may be carried out by using the following steps, for example (cf. the flow chart of FIG. 5):

(200*a*) the fuel pressure in pressure storage device 13 is regulated to an identical pressure setpoint value 66, in each case (see FIG. 3) with the aid of pressure regulation 19 during first and second measuring intervals 60 and 62, respectively, (see FIG. 3);

(200*b*) actuator 18 of injector 9 is activated periodically multiple times for a short period of time during first measuring interval 60 in such a way that a control quantity of the fuel is withdrawn from pressure storage device 13, injector 9 not yet injecting fuel into combustion chamber 4;

(200*c*) during activation of injector 9, a first value of a performance quantity of pressure regulation 19, in particular a manipulated variable 25 of a pressure regulator and/or a fuel metering device 22 and/or pressure regulation valve 14*a*, is ascertained;

(200*d*) injector 9 is activated during second measuring interval 62 in such a way that no control quantity of the fuel is withdrawn from pressure storage device 13; actuator 18 is preferably not activated at all in this step (d);

(200*e*) a second value of the performance quantity of pressure regulation 19 is ascertained;

(200*f*) a difference 70 (see FIG. 3) between the first value and the second value of the performance quantity is ascertained; and (200*g*) difference 70 is compared to a difference 70, which has been ascertained under comparable conditions and which is stored in control and/or regulating device 15 of internal combustion engine 1, and the state of pressure sensor 14 is deduced therefrom.

When carrying out the mentioned steps (200*a*) through (200*g*), the fuel pressure, the fuel temperature, and the fuel type are taken into account as parameters.

Figure 2:
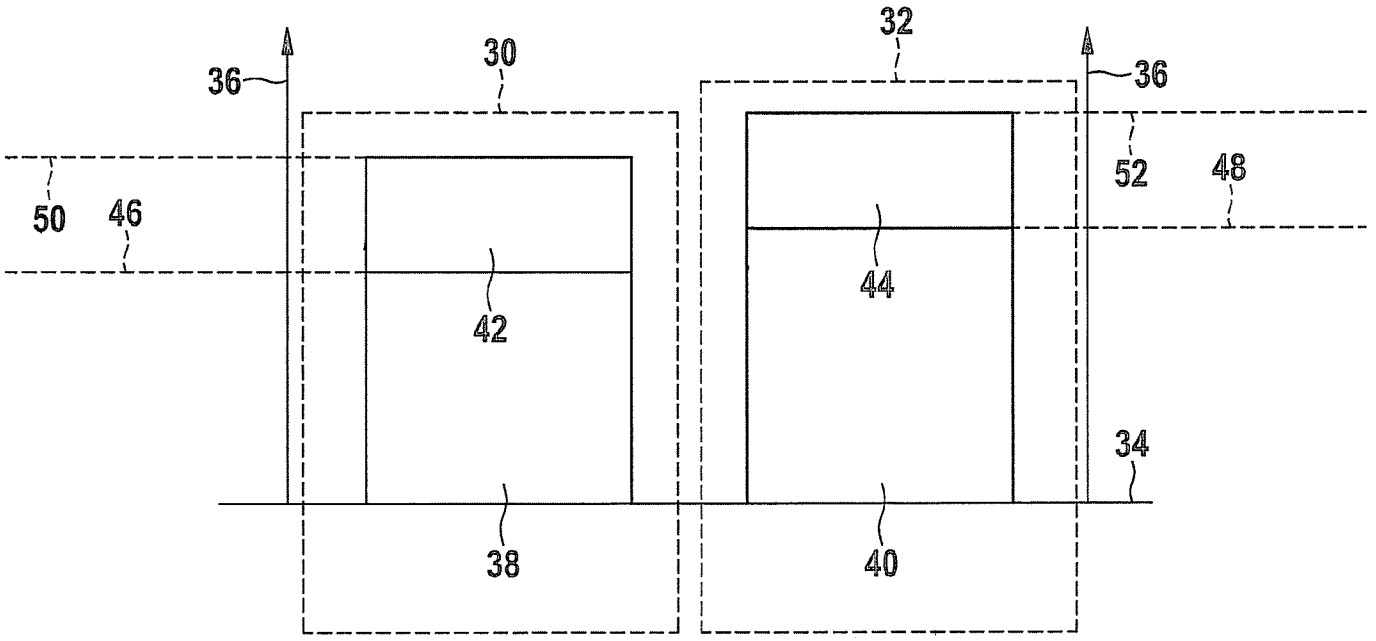
FIG. 2 shows a bar diagram having two aging states of the fuel injection system.

FIG. 2 shows a bar diagram having two aging states of fuel injection system 100. A bar diagram 30 (left-hand side of the drawing) describes a new condition of fuel injection system 100 or injector 9. A bar diagram 32 (right-hand side of the drawing) describes a state of fuel injection system 100 or of injector 9 after a certain operating period. Delivery quantities 36 of the fuel which, in the present case, are caused by leakages 38 and 40 on the one hand, and control quantities 42 and 44 of injector 9 on the other hand are indicated perpendicularly to an abscissa 34. In both bar diagrams 30 and 32, the horizontal dashed lines each show a first delivery quantity 46 and 48, respectively, and a second delivery quantity 50 and 52, respectively. In this case, first delivery quantities 46 and 48 correspond to particular leakages 38 and 40, respectively, of injector 9 and second delivery quantities 50 and 52 correspond to particular leakages 38 and 40, respectively, plus to particular control quantities 42 and 44, respectively.

Both bar diagrams 30 and 32 together illustrate the result underlying the exemplary embodiments and/or exemplary methods of the present invention. It is apparent that leakage 40 of an "old" injector 9 is, for example, stronger than leakage 38 of a "new" injector 9. Control quantities 42 and 44 are, however, identical. For this reason, control quantities 42 and 44 are used to enable a defined fuel withdrawal from pressure storage device 13 during first measuring interval 60 (see subsequent FIGS. 3 and 4). During a second measuring interval 62 (see subsequent FIGS. 3 and 4), no control quantities 42 or 44 are, however, withdrawn from pressure storage device 13. However, during both measuring intervals 60 and 62, fuel is withdrawn from pressure storage device 13 as a result of leakages 38 and 40. Particular control quantities 42 and 44 may be deduced from a difference formation of the fuel quantity withdrawn during each of first and second measuring intervals 60 and 62. The state of pressure sensor 14 may be deduced therefrom.

If control quantity 44, which has been ascertained according to the exemplary embodiments and/or exemplary methods of the present invention after a certain operation period, deviates from control quantity 42 ascertained in new condition, it is assumed according to the exemplary embodiments and/or exemplary methods of the present invention that the reason therefor is an incorrectly regulated fuel pressure in pressure storage device 13, due to the presumed good reproducibility of control quantities 42 and 44.

In the case that, if the fuel pressure in pressure storage device 13 is regulated seemingly correctly, control quantity 44 is greater than control quantity 42, it is assumed that pressure sensor 14 displays an excessively low fuel pressure in pressure storage device 13, i.e., the actual fuel pressure is higher. In the case that, if the fuel pressure in pressure storage device 13 is regulated seemingly correctly, control quantity 44 is smaller than control quantity 42, it is assumed that pressure sensor 14 displays an excessively high fuel pressure in pressure storage device 13, i.e., the actual fuel pressure is lower.

FIG. 3 shows a first set of diagrams (A) through (D) over a time t plotted on the abscissa. In a lower area of the drawing, activating signals 58 are illustrated, each of which define a first measuring interval 60 using amplitude "1." Using amplitude "0," a second measuring interval 62, which directly adjoins first measuring interval 60 in each case, is defined for each first measuring interval 60. In the present case, a particular duration of first measuring interval 60 is different in diagrams (A) through (D). Second measuring intervals 62 each have the same duration as their associated first measuring intervals 60. In contrast to the illustration in FIG. 3, first measuring intervals 60, and accordingly second measuring intervals 62, may have the same duration. As a result, the method according to the present invention may possibly be simplified and the accuracy may be increased.

In a central area of the drawing, a performance quantity 64 of pressure regulation 19 of fuel injection system 100 is plotted in each case. Performance quantity 64 characterizes a rate of the fuel withdrawn from pressure storage device 13. In an upper area of the drawing, a pressure setpoint value 66 is plotted, which is associated for each case and which represents a parameter. A fuel pressure 68 is regulated as a function of pressure setpoint value 66.

Some of the curves illustrated in diagrams (A) through (D) in the central and the upper areas are shifted vertically in relation to one another for illustration reasons. For example, pressure setpoint value 66 incrementally increases from diagram (A) to diagram (D) in FIG. 3; however, the associated lines or curves in the drawing show approximately similar vertical dimensions. In addition, performance quantities 64 of second measuring intervals 62 are vertically identical in relation to one another to allow for better comparison with first measuring intervals 60.

During each of first measuring intervals 60, multiple fuel withdrawals from pressure storage device 13 are performed periodically. Actuator 18 of injector 9 is activated for each individual withdrawal for such a short period of time that injector 9 does not yet inject fuel into combustion chamber 4 of internal combustion engine 1. For this reason, a control quantity of the fuel is withdrawn from pressure storage device 13 for activating a servo-valve of injector 9, and is subsequently supplied to fuel injection system 100 via a return line. In this case, no contribution is made to a torque of internal combustion engine 1.

During second measuring interval 62, no fuel withdrawal of this type is performed, i.e., the servo-valve is not activated for withdrawing a control quantity of the fuel. The remaining operating conditions of internal combustion engine 1 during second measuring interval 62 should, however, be as similar as possible to the operating conditions during first measuring interval 60. First and second measuring intervals 60, 62 may follow each other directly.

The fuel quantity withdrawn additionally during first measuring interval 60 may be ascertained for the at least one withdrawal from a difference 70 between performance quantities 64 ascertained during first and second measuring intervals 60 and 62. Difference 70 may be formed from mean values of performance quantities 64 during first measuring interval 60 and second measuring interval 62 in order to increase the accuracy of the method. A certain sequence of first measuring interval 60 and second measuring interval 62 is, however, not necessary, i.e., "second" measuring interval 62 in diagrams (A) through (D) may also precede associated first measuring interval 60.

The method according to the present invention may be carried out particularly easily and accurately if it is carried out during an operating mode of internal combustion engine 1 during which usually no injection of fuel into combustion chamber 4 of internal combustion engine 1 is provided. For example, the method may be carried out during a coasting mode of internal combustion engine 1 during which no fuel is injected for a relatively long period of time. It is, however, also possible to carry out the method during a gas exchange phase during one or multiple operating cycles of internal combustion engine 1.

Figure 4:
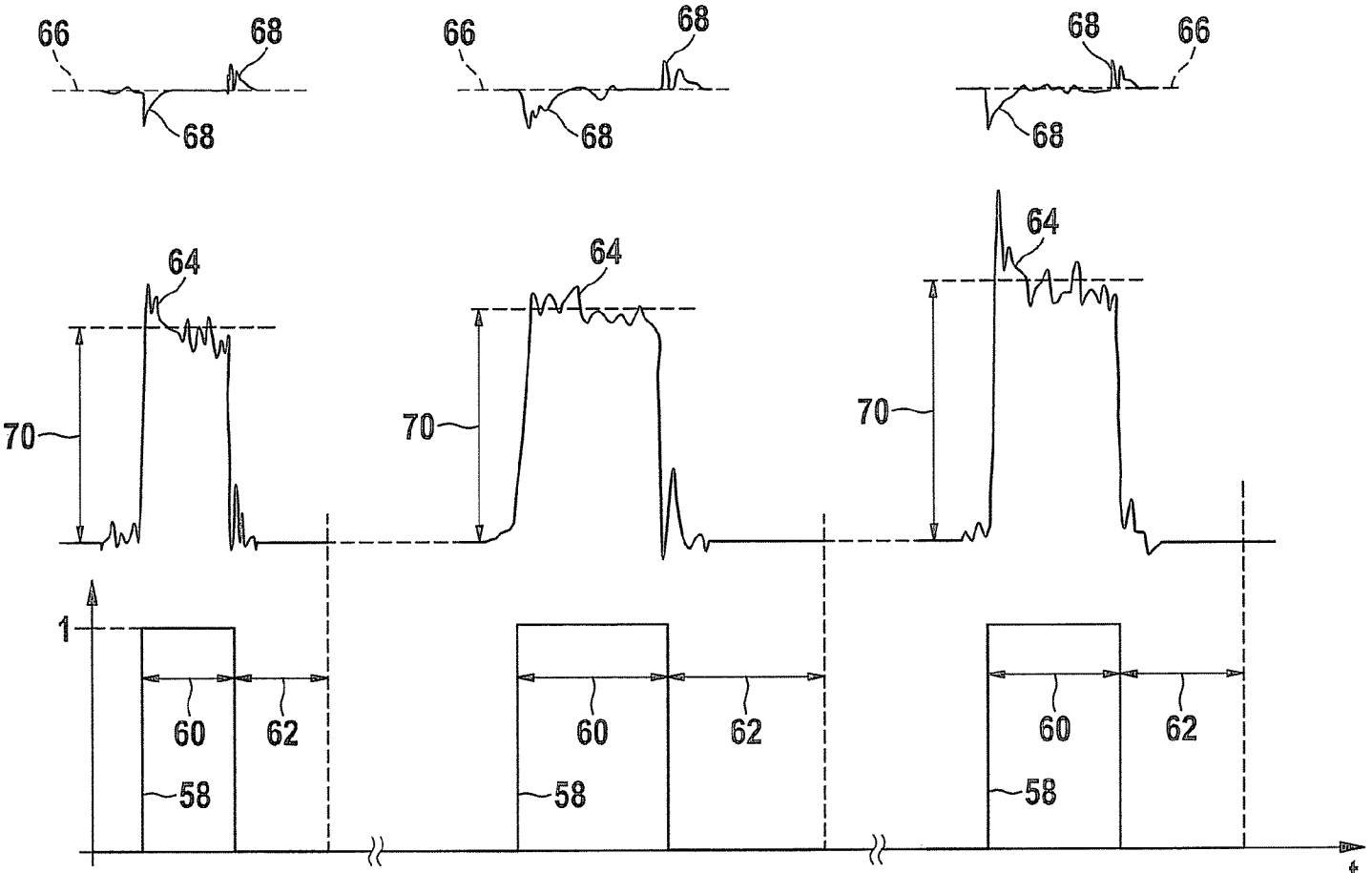
FIG. 4 shows a second diagram having the delivery quantities and pressures of a fuel.

FIG. 4 shows a second set of diagrams (E) through (G) over time t, similar to the four diagrams (A) through (D) of FIG. 3. Diagrams (E) through (G) also have incrementally increasing pressure setpoint values 66, starting from pressure setpoint value 66 of diagram (D). FIG. 4 is thus a continuation of the illustration of FIG. 3. Regarding the details of the drawing, the same applies as for FIG. 3.

It is apparent from FIGS. 3 and 4 that the rate (performance quantity 64) of the fuel withdrawn from pressure storage device 13 is greater during each of first measuring intervals 60 than during each of second measuring intervals 62. This is due to control quantities 42 and 44 which were withdrawn during first measuring intervals 60. A leakage 38 or 40 of injector 9 is, however, approximately identical for the two measuring intervals 60 and 62. It is further apparent that difference 70 continuously increases in diagrams (A) through (G) according to higher pressure setpoint value 66 or fuel pressure 68 in each case. This results in fuel pressure 68 illustrating a parameter when ascertaining control quantities 42 and 44.

What is claimed is:

1. A method for operating a fuel injection system of an internal combustion engine, the method comprising:

providing pressurized fuel in a pressure storage device;

during a first measuring interval:

performing at least one controlled withdrawal of a predetermined quantity of fuel from the pressure storage device, thereby causing a controlled change in a fuel pressure prevailing in the pressure storage device;

a pressure sensor sensing, and outputting a signal corresponding to, a fuel pressure prevailing in the pressure storage device during the first measuring interval as a result of the controlled withdrawal of the predetermined quantity of fuel;

regulating, by a pressure regulation device, the fuel pressure prevailing in the pressure storage in response to the signal output by the pressure sensor during the first measuring interval; and ascertaining a performance quantity characterizing the pressure regulation performed in response to the signal output by the pressure sensor during the first measuring interval;

during a second measuring interval, during which no controlled withdrawal of fuel from the pressure storage device is performed:

the pressure sensor sensing, and outputting a signal corresponding to, a fuel pressure prevailing in the pressure storage device during the second measuring interval;

regulating, by the pressure regulation device, the fuel pressure prevailing in the pressure storage in response to the signal output by the pressure sensor during the second measuring interval; and ascertaining a performance quantity characterizing the pressure regulation performed in response to the signal output by the pressure sensor during the second measuring interval; and determining a condition of the pressure sensor based on a difference between the performance quantity ascertained for the first measuring interval and the performance quantity ascertained for the second measuring interval.

2. The method of claim 1, wherein the at least one fuel withdrawal is performed by activating a servo-valve of an injector of the internal combustion engine so that a control quantity of the fuel is withdrawn, at which the injector does not yet inject fuel into a combustion chamber of the internal combustion engine.

3. The method of claim 1, wherein a servo-valve of an injector of the internal combustion engine is activated multiple times for withdrawing a control quantity during the first measuring interval.

4. The method of claim 1, wherein the first and second measuring intervals are during an operating mode of the internal combustion engine in which usually there is no injection of fuel into a combustion chamber of the internal combustion engine.

5. The method of claim 1, wherein:

the regulating of the fuel pressure includes regulating the fuel pressure in the pressure storage device to an identical pressure setpoint value, with the aid of the pressure regulation, in each of the first measuring interval and the second measuring interval;

the at least one fuel withdrawal is performed by activating the injector during the first measuring interval so that a control quantity of the fuel is withdrawn from the pressure storage device, the injector not yet injecting fuel into the combustion chamber;

the ascertaining of the performance quantity of the first measuring interval includes ascertaining, during the activation of the injector, a first value of the performance quantity of the pressure regulation, which is a manipulated variable of at least one of a pressure regulator and a fuel metering device; and the determining of the condition of the pressure sensor includes comparing the difference to a difference that had been previously ascertained under comparable conditions and which is stored in a control/regulating unit of the internal combustion engine.

6. The method of claim 1, wherein values of the performance quantity of the pressure regulation are ascertained in the first measuring interval and the second measuring interval both when the fuel injection system is in a new condition and when the fuel injection system is in an older condition, and the values ascertained in the first and second measuring intervals when the fuel injection system is in the older condition are compared to the values ascertained in the first and second measuring intervals when the fuel injection system was in the new condition, and the state of the pressure sensor is deduced from the comparison.

7. The method of claim 1, wherein the performance quantity of the pressure regulation is ascertained at least one of at different fuel pressures, at different fuel temperatures, for different fuel types, and for different activation periods of one of an injector and an servo-valve of the injector.

8. A non-transitory computer readable medium having a computer program, which is executable by a processor, comprising:

a program code arrangement having program code for operating a fuel injection system of an internal combustion engine, by performing the following:

providing pressurized fuel in a pressure storage device;

during a first measuring interval:

performing at least one controlled withdrawal of a predetermined quantity of fuel from the pressure storage device, thereby causing a controlled change in a fuel pressure prevailing in the pressure storage device;

obtaining from a pressure sensor a signal corresponding to a fuel pressure prevailing in the pressure storage device during the first measuring interval as a result of the controlled withdrawal of the predetermined quantity of fuel;

controlling a pressure regulation device to regulate the fuel pressure prevailing in the pressure storage in response to the signal output by the pressure sensor during the first measuring interval; and ascertaining a performance quantity characterizing the pressure regulation performed in response to the signal output by the pressure sensor during the first measuring interval;

during a second measuring interval, during which no controlled withdrawal of fuel from the pressure storage device is performed:

obtaining from the pressure sensor a signal corresponding to, a fuel pressure prevailing in the pressure storage device during the second measuring interval;

controlling the pressure regulation device to regulate the fuel pressure prevailing in the pressure storage in response to the signal output by the pressure sensor during the second measuring interval; and ascertaining a performance quantity characterizing the pressure regulation performed in response to the signal output by the pressure sensor during the second measuring interval; and determining a condition of the pressure sensor based on a difference between the performance quantity ascertained for the first measuring interval and the performance quantity ascertained for the second measuring interval.

9. A control/regulating unit of an internal combustion engine, comprising:

a computer readable medium having a computer program, which is executable by a processor, including a program code arrangement having program code for operating a fuel injection system of an internal combustion engine, by performing the following:

providing pressurized fuel in a pressure storage device;

during a first measuring interval:

performing at least one controlled withdrawal of a predetermined quantity of fuel from the pressure storage device, thereby causing a controlled change in a fuel pressure prevailing in the pressure storage device;

obtaining from a pressure sensor a signal corresponding to a fuel pressure prevailing in the pressure storage device during the first measuring interval as a result of the controlled withdrawal of the predetermined quantity of fuel;

controlling a pressure regulation device to regulate the fuel pressure prevailing in the pressure storage in response to the signal output by the pressure sensor during the first measuring interval; and ascertaining a performance quantity characterizing the pressure regulation performed in response to the signal output by the pressure sensor during the first measuring interval;

during a second measuring interval, during which no controlled withdrawal of fuel from the pressure storage device is performed:

obtaining from the pressure sensor a signal corresponding to, a fuel pressure prevailing in the pressure storage device during the second measuring interval;

controlling the pressure regulation device to regulate the fuel pressure prevailing in the pressure storage in response to the signal output by the pressure sensor during the second measuring interval; and ascertaining a performance quantity characterizing the pressure regulation performed in response to the signal output by the pressure sensor during the second measuring interval; and determining a condition of the pressure sensor based on a difference between the performance quantity ascertained for the first measuring interval and the performance quantity ascertained for the second measuring interval.

10. The method of claim 3, wherein the activation is periodic.

11. The method of claim 5, wherein the pressure regulator is a pressure regulation valve.

12. The method of claim 1, wherein values of the performance quantity of the pressure regulation are ascertained in the first measuring interval and the second measuring interval both when an injector of the fuel injection system is in a new condition and when the injector is in an older condition, and the values ascertained in the first and second measuring intervals when the injector is in the older condition are compared to the values ascertained in the first and second measuring intervals when the injector was in the new condition, and the state of the pressure sensor is deduced from the comparison.

13. The method of claim 1, wherein values of the performance quantity of the pressure regulation are ascertained in the first measuring interval and the second measuring interval both when the pressure sensor of the fuel injection system is in a new condition and when the pressure sensor is in an older condition, and the values ascertained in the first and second measuring intervals when the pressure sensor is in the older condition are compared to the values ascertained in the first and second measuring intervals when the pressure sensor was in the new condition, and the state of the pressure sensor is deduced from the comparison.

14. A method for operating a fuel injection system of an internal combustion engine, the method comprising:

providing pressurized fuel in a pressure storage device;

regulating a fuel pressure prevailing in the pressure storage device with the aid of a pressure regulation device;

during a first measuring interval, performing at least one fuel withdrawal from the pressure storage device, and during a second measuring interval, not withdrawing fuel from the pressure storage device;

during the first measuring interval and the second measuring interval, ascertaining a performance quantity of the pressure regulation in each case;

ascertaining, as a measurement of the fuel quantity withdrawn during the first measuring interval, a difference between the ascertained performance quantities; and determining that a pressure sensor is outputting pressure values that are higher than actual pressures that are being sensed and represented by the output pressure values in response to the ascertained measurement of the fuel quantity being lower than a predetermined value.

15. A method for operating a fuel injection system of an internal combustion engine, the method comprising:

providing pressurized fuel in a pressure storage device;

regulating a fuel pressure prevailing in the pressure storage device with the aid of a pressure regulation device;

during a first measuring interval, performing at least one fuel withdrawal from the pressure storage device, and during a second measuring interval, not withdrawing fuel from the pressure storage device;

during the first measuring interval and the second measuring interval, ascertaining a performance quantity of the pressure regulation in each case;

ascertaining, as a measurement of the fuel quantity withdrawn during the first measuring interval, a difference between the ascertained performance quantities; and determining that a pressure sensor is outputting pressure values that are lower than actual pressures that are being sensed and represented by the output pressure values in response to the ascertained measurement of the fuel quantity being higher than a predetermined value.

16. A method for operating a fuel injection system of an internal combustion engine, the method comprising:

providing pressurized fuel in a pressure storage device;

regulating a fuel pressure prevailing in the pressure storage device with the aid of a pressure regulation device;

during a first measuring interval, performing at least one fuel withdrawal from the pressure storage device, and during a second measuring interval, not withdrawing fuel from the pressure storage device;

during the first measuring interval and the second measuring interval, ascertaining a performance quantity of the pressure regulation in each case;

ascertaining, as a measurement of the fuel quantity withdrawn during the first measuring interval, a difference between the ascertained performance quantities; and executing an algorithm according to which a condition of a pressure sensor is determined, wherein the determining the condition by the execution of the algorithm includes:

determining that the pressure sensor is outputting pressure values that are higher than actual pressures that are being sensed and represented by the output pressure values if the ascertained fuel quantity is lower than a predetermined value; and determining that the pressure sensor is outputting pressure values that are lower than actual pressures that are being sensed and represented by the output pressure values if the ascertained fuel quantity is higher than a predetermined value.

17. The method of claim 4, wherein the first and second measuring intervals are during at least one of a coasting mode and a gas exchange phase.

18. The method of claim 1, wherein the first and second measuring intervals are during periods in which the engine is operational without any injection into the internal combustion engine.

19. The method of claim 1, wherein the pressure regulations in the first and second measuring intervals include performing a control to counter any deviations from a constant pressure being maintained in the pressure storage device throughout the first and second intervals.

20. The method of claim 1, wherein the pressure regulations in the first and second measuring intervals include providing fuel to the pressure storage device in order to counter any deviations from a constant pressure being maintained in the pressure storage device throughout the first and second intervals, and the performance quantities correspond to respective meterings of fuel into the pressure storage device to counter the deviations and bring the pressure in the pressure storage device back to the constant pressure.

21. The method of claim 1, wherein the pressure regulations in the first and second measuring intervals include providing fuel to the pressure storage device in order to counter any deviations from a constant pressure being maintained in the pressure storage device throughout the first and second intervals, and the performance quantities represent respective states of a fuel metering device for metering fuel into the pressure storage device to counter the deviations and bring the pressure in the pressure storage device back to the constant pressure.

22. The method of claim 1, wherein the pressure regulations in the first and second measuring intervals include providing fuel to the pressure storage device in order to counter any deviations from a constant pressure being maintained in the pressure storage device throughout the first and second intervals, and the performance quantities represent respective states of a pressure regulation valve for countering the deviations and bringing the pressure in the pressure storage device back to the constant pressure.

23. The method of claim 1, wherein the withdrawal of the predetermined quantity of fuel is not based on the signal output by the pressure sensor and is not based on the regulating performed by the pressure regulation device.

* * * * *